US010537195B1

(12) United States Patent
Giles et al.

(10) Patent No.: US 10,537,195 B1
(45) Date of Patent: Jan. 21, 2020

(54) SECURED PACKAGE HOLDER DEVICE

(71) Applicant: Alarm.com Incorporated, Tysons, VA (US)

(72) Inventors: Chad Giles, St. Paul, MN (US); Linnea Giles, St. Paul, MN (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 15/932,352

(22) Filed: Feb. 16, 2018

Related U.S. Application Data

(60) Provisional application No. 62/459,872, filed on Feb. 16, 2017.

(51) Int. Cl.

| | |
|---|---|
| ***A47G 29/14*** | (2006.01) |
| ***A47G 29/20*** | (2006.01) |
| ***G07C 9/00*** | (2006.01) |
| ***G08B 13/196*** | (2006.01) |

(52) U.S. Cl.
CPC ..... *A47G 29/141* (2013.01); *A47G 29/20* (2013.01); *G07C 9/00912* (2013.01); *G08B 13/19602* (2013.01); *A47G 2029/144* (2013.01); *A47G 2029/146* (2013.01); *A47G 2029/149* (2013.01)

(58) Field of Classification Search
CPC ..... G08B 1/00; G06Q 10/00
See application file for complete search history.

(56) References Cited

U.S. PATENT DOCUMENTS

| | | | | |
|---|---|---|---|---|
| 5,624,071 | A | 4/1997 | Sosan | |
| 5,921,117 | A | 7/1999 | Illguth | |
| 6,138,910 | A | 10/2000 | Madruga | |
| 6,155,715 | A | 12/2000 | Lake et al. | |
| 6,344,796 | B1 * | 2/2002 | Ogilvie | A47G 29/141 340/5.2 |
| 6,690,997 | B2 | 2/2004 | Rivalto | |
| 6,845,909 | B2 | 1/2005 | Bong | |
| 6,866,195 | B2 | 3/2005 | Knowles | |
| 9,244,147 | B1 | 1/2016 | Soundararajan et al. | |
| 9,508,239 | B1 | 11/2016 | Harrison | |
| 10,267,668 | B1 | 4/2019 | Slavin | |
| 2001/0045180 | A1 | 11/2001 | McCormick et al. | |
| 2002/0162883 | A1 | 11/2002 | Arvonio et al. | |
| 2008/0121682 | A1 | 5/2008 | Grim et al. | |
| 2014/0008246 | A1 | 1/2014 | Pfeiffer | |
| 2015/0310381 | A1 | 10/2015 | Lyman et al. | |
| 2015/0356801 | A1 * | 12/2015 | Nitu | G07C 9/00912 340/5.61 |
| 2016/0180667 | A1 | 6/2016 | Bunker | |
| 2017/0011605 | A1 * | 1/2017 | Grabham | G08B 13/1472 |
| 2017/0091711 | A1 | 3/2017 | Akselrod | |

* cited by examiner

*Primary Examiner* — Shirley Lu

(74) *Attorney, Agent, or Firm* — Fish & Richardson P.C.

(57) ABSTRACT

A monitoring system is configured to monitor a property. The monitoring system includes a package holder device that is configured to receive a package at the package holder device. The package holder device is configured to secure the package. The package holder device is configured to arm the package holder device. The monitoring system includes a monitoring control unit that is configured to receive, from the package holder device, data indicating that the package holder device secured the package and that the package holder device armed. The monitoring control unit is configured to communicate, to a user device of a resident of the property, a package delivery confirmation notification indicating that the package holder device received and secured the package.

13 Claims, 7 Drawing Sheets

SECURED PACKAGE HOLDER DEVICE

CROSS REFERENCE TO RELATED APPLICATIONS

This application claims benefit of U.S. Provisional Application No. 62/459,872, filed Feb. 16, 2017, and titled "Secured Package Holder Device," which is incorporated by reference in its entirety.

TECHNICAL FIELD

This disclosure relates to property monitoring technology and, for example, integrating a secured package holder device into a property monitoring system.

BACKGROUND

Many people equip homes and businesses with monitoring systems to provide increased security for their homes and businesses.

SUMMARY

Techniques are described for monitoring technology. For example, techniques are described for integrating a secured package holder device into a monitoring system to allow for the monitoring of packages delivered to a monitored property.

According to an innovative aspect of the subject matter describe in this specification, a monitoring system is configured to monitor a property. The monitoring system includes a package holder device that is configured to receive a package at the package holder device; secure the package; and arm the package holder device. The monitoring system includes a monitoring control unit that is configured to receive, from the package holder device, data indicating that the package holder device secured the package and that the package holder device armed; and communicate, to a user device of a resident of the property, a package delivery confirmation notification indicating that the package holder device received and secured the package.

This and other implementations may each optionally include one or more of the following features. The monitoring control unit is configured to receive a disarm code; compare the received disarm code to a stored disarm code; and disarm the package holder device based on the received disarm code matching the stored disarm code. The package holder device is configured to detect that one or more arms of the package holder device are locked around the package; and arm based on the detection that the one or more arms of the package holder device are locked around the package. The monitoring control unit is configured to compare the received disarm code to the stored disarm code by comparing the received disarm code to a disarm code that disarms the monitoring system while the monitoring system is in an armed state, and disarm the package holder device by disarming the package holder device based on the received disarm code matching the disarm code that disarms the monitoring system while the monitoring system is in an armed state. The monitoring control unit is configured to compare the received disarm code to the stored disarm code by comparing the disarm code to a disarm code that disarms the package holder device and that does not disarm the monitoring system while the monitoring system is in an armed state, and disarm the package holder device by disarming the package holder device based on the received disarm code matching the disarm code that disarms the package holder device and that does not disarm the monitoring system while the monitoring system is in an armed state.

The monitoring control unit is configured to receive the disarm code by receiving, from a monitoring system application running on the user device of a resident of the property, the disarm code. The monitoring system includes a motion sensor that is in a vicinity of the package holder device and that is configured to generate motion data in response to detecting motion. The monitoring control unit is configured to receive a shipping notification that indicates an expected delivery of the package; receive, from the motion sensor, motion data; based on the shipping notification and the motion data, generate a voice command that includes instructions for securing the package into the package device holder device; and transmit, to the package holder device, the voice command. The package holder device is configured to output the voice command. The shipping notification includes package size data that indicates a size of the package. The monitoring control unit is configured to generate the voice command that includes the instructions for securing the package into the package device holder device based on the package size data that indicates the size of the package. The monitoring system includes a camera that is in a vicinity of the package holder device and that is configured to capture image data.

The monitoring control unit is configured to receive a shipping notification that indicates an expected delivery of the package; receive, from the camera, image data; analyze the image data that; based on analyzing the image data, determine that a person holding a package is in the vicinity of the package holder device; and based on the shipping notification and determining that the person holding the package is in the vicinity of the package holder device, generate a voice command that includes instructions for securing the package into the package device holder device; and transmit, to the package holder device, the voice command. The package holder device is configured to output the voice command. The monitoring control unit is configured to, based on analyzing the image data, estimate a size of the package; and generate the voice command that includes the instructions for securing the package into the package device holder device based on the estimated size of the package. The monitoring control unit is configured to receive, from the package holder device, location data that indicates a location of the package holder device; based on the location data, determine that the package holder device is inside the property; and disarm the package holder device based on determining that the package holder device is inside the property. The package holder device is configured to determine that the package holder device is located outside of a threshold distance of the property; and generate an alarm based on determining that the package holder device is located outside of the threshold distance of the property.

The monitoring control unit is configured to determine that the package holder device is located outside of a threshold distance of the property; and, based on determining that the package holder device is located outside of the threshold distance of the property, provide an instruction to other monitoring systems in a vicinity of the property to activate one or more image capturing devices of the other monitoring systems. The monitoring control unit is configured to receive a shipping notification that indicates an expected delivery of the package; receive; from the package holder device, movement data that indicates movement of the package holder device; based on the movement data, determine that the movement of the package holder device satisfies a movement threshold; and, based on the shipping notification and the determining that the movement of the package holder device satisfies a movement threshold, generate a voice command that includes instructions for securing the package into the package device holder device; transmit, to the package holder device, the voice command. The package holder device is configured to output, by the package holder device, the voice command. The monitoring control unit is configured to receive, from the package holder device, movement data that indicates movement of the package holder device by receiving accelerometer data from an accelerometer included in the package holder device; and receiving gyroscope data from a gyroscope included in the package holder device. The monitoring control unit is configured to monitor the package holder device that secured the package and that is armed; while monitoring the package holder device that secured the package and that is armed, determining that the package holder device is disarmed; and, based on determining that the package holder device is disarmed, ceasing to monitor the package holder device.

According to another innovative aspect of the subject matter describe in this specification, a method includes the actions of detecting, by a package holder device of a monitoring system that is configured to monitor a property and that includes the package holder device, that a package has been placed on and secured by the package holder device; and, in response to detecting that the package has been placed on and secured by the package holder device arming the package holder device; and communicating, to a user device of a resident of the property, a package delivery confirmation notification indicating that the package holder device received and secured the package.

This and other implementations may each optionally include one or more of the following features. The actions further include receiving, by the monitoring system, a disarm code; comparing the received disarm code to a stored disarm code; and disarming the package holder device based on the received disarm code matching the stored disarm code. The actions further include monitoring the package holder device that secured the package and that is armed; while monitoring the package holder device that secured the package and that is armed, determining that the package holder device is disarmed; and, based on determining that the package holder device is disarmed, ceasing to monitor the package holder device. The actions further include receiving a shipping notification that indicates an expected delivery of the package; receiving, from a camera that is in a vicinity of the package holder device and that is configured to capture image data, image data; analyzing the image data that; based on analyzing the image data, determining that a person holding a package is in the vicinity of the package holder device; based on the shipping notification and determining that the person holding the package is in the vicinity of the package holder device, generating a voice command that includes instructions for securing the package into the package device holder device; and transmitting, to the package holder device for output by the package holder device, the voice command.

Implementations of the described techniques may include hardware, a method or process implemented at least partially in hardware, or a computer-readable storage medium encoded with executable instructions that, when executed by a processor, perform operations.

The details of one or more implementations are set forth in the accompanying drawings and the description below. Other features will be apparent from the description and drawings, and from the claims.

DETAILED DESCRIPTION

Techniques are described for integrating one or more package holder devices into a monitoring system to allow for the safe delivery of packages to a property. A secured package holder device may be placed outside a monitored property to receive delivered packages. The package holder device may include cables that allow a delivery man to secure one or more packages into the holder device. The cables around the package may only be unlocked when a user associated with the monitored property unlocks the cables through a native application on the user device. The monitoring system at the property then monitors the package secured within the package holder device to ensure that the package is not removed from the property, or otherwise tampered with before the user at the monitored property retrieves the package.

Figure 1:
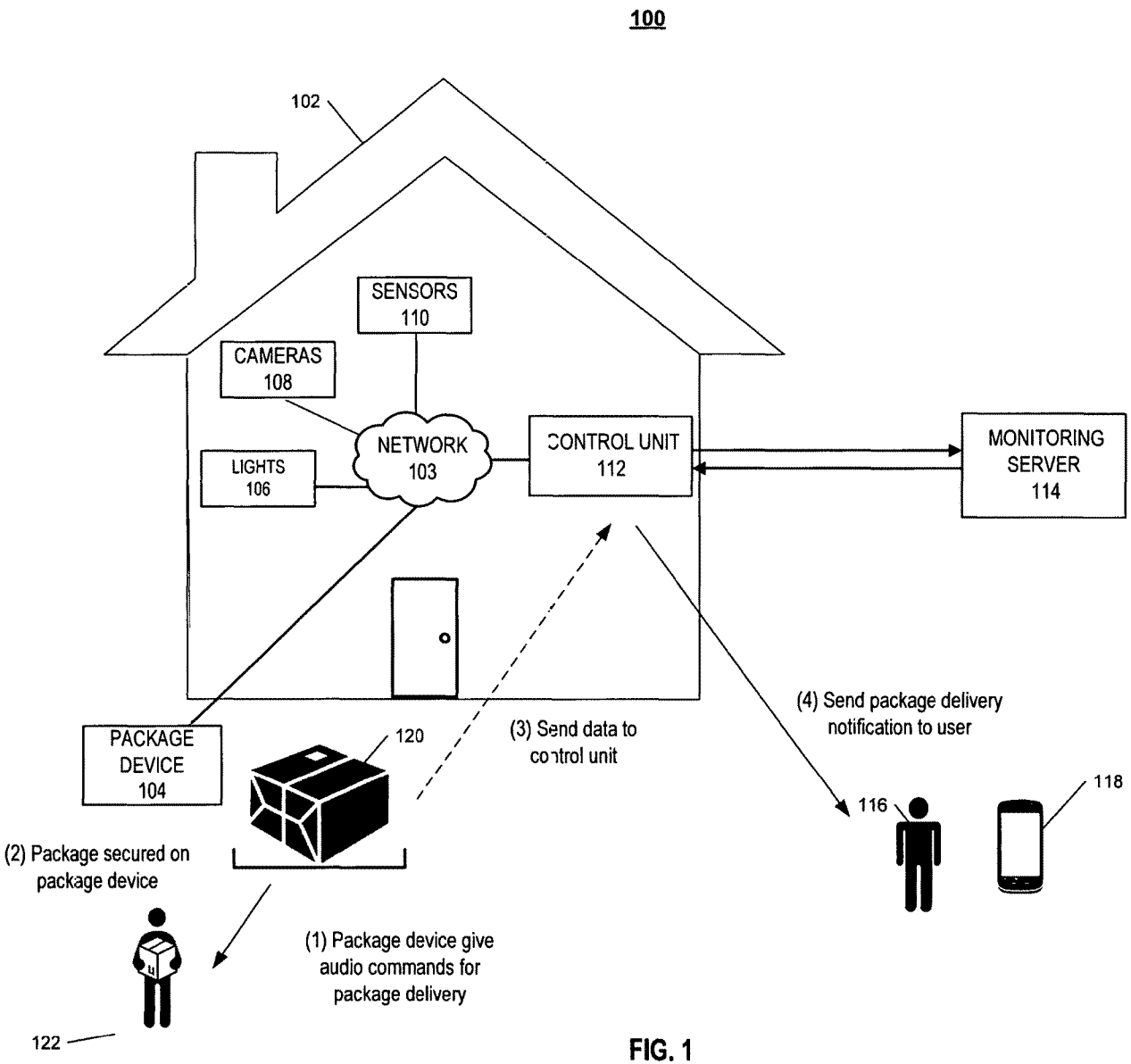
FIG. 1 illustrates an example of a system for securing a delivered package in a package holder device.

FIG. 1 illustrates an example of a monitoring system 100 integrated with a package holder device 104. As shown in FIG. 1, a property 102 (e.g. a home) of a user 116 is monitored by an in-home monitoring system (e.g. in-home security system) that includes components that are fixed within the property 102. The in-home monitoring system may include a control unit 112, one or more sensors 110, one or more cameras 108, one or more lights 106, and one or more package holder devices 104. The user 116 may integrate one or more package devices 104 into the in-home monitoring system to monitor the packages delivered to the monitored property 102 when the user 116 is away. Each of the package holder devices may be small, lightweight, and portable. The user may place the package device 104 outside of the monitored property 102 when a package is expected. For example, a package holder device may be placed on the porch of the property, or by the garage door of the property. The package holder device 104 may be fixed to an external area of the monitored property. For example, the package holder device 104 may be fixed by a secured cable to the porch of the property.

In the example shown in FIG. 1, a delivery man 122 may deliver a package 120 to the monitored property 102. The package holder device 104 may be formed as a square landing pad that has cables that extend from each of the four sides. In some examples, the cables of two opposite sides of the package holder device 104 may have interlocking clip ends, and the cables of the other two opposite sides may have buckle ends. The package holder device 104 may, in some examples, include more or less cables for strapping in a package. For example, a package holder device may include eight cables. In other examples, the ends of the cables may have any other suitable securing mechanism. In some examples, the package holder device may be formed as a rectangular landing pad, or any other suitable shape landing pad to facilitate a package. The cables of the package holder device 104 may be formed of a strong flexible material, and may extend long enough to secure any sized package.

The package device 104 may have instructions printed on the landing pad that describe the steps for securing a package into the package holder device. The delivery man 122 may approach the package device 104, read the step by step instructions printed on the device, and follow the instructions to secure the package 120 in the package holder device 104. In the example illustrated in FIG. 1, the delivery man 122 may receive audio commands of the securing instructions from the package holder device 104. For example, the delivery man 122 may press a button located on a side of the package device prompting the speaker to output the step by step directions for securing a package in the package device 104. In some implementations, an external camera at the property may detect the delivery man approaching 122 with a package 120, and may prompt the control unit 112 to command the package holder device 104 to generate the audio commands. In other implementations, the monitored property 102 may be equipped with a motion detector sensor that can sense the delivery man approaching and communicate with the control unit to prompt the speaker on the package holder device 104 to output the securing instructions. In yet another implementation, the package holder device 104 may be equipped with a motion detector. In some implementations, the delivery man 122 may approach the package holder device 104 and press a button to initiate a two-way voice conversation with the user 116 through a monitoring system native application. The delivery man may wish to communicate with the user 116 to receive further securing instructions, or may simply communicate with the user to notify the user 116 of the delivery of the package 120.

The delivery man 122 may strap the package 120 into the package holder device 104 by extending the cables from the opposite ends around the package and securing the ends of the cables together, and then extending the other two cables and securing the ends together. When the cables of the package holder device 120 are fastened around the package, the cables automatically tighten and lock into position. The speaker may generate an audible notification to notify the delivery man 122 when the package 104 is secured in the package holder device 104. An LED on the side landing strip of the package holder device 104 may light up green when the user is expecting a package, and may light up red when the package is securely strapped into the device 104. The cables may be unlocked when the user 116 enters the unlock code in the native application on a user device 118. The cables of the package holder device 104 may be retracted when they are accidently hyperextended by pressing a retract button on the side of the package device 104. In some examples, the cables around the package 120 may be automatically unlocked when the user 116 arrives at home and disarms the monitoring system. In another example, the cables around the package 120 may be automatically unlocked when the user 116 moves the package holder device 104 into the monitored property.

In some implementations, the user may not be expected back to the monitored property for a long period of time. For example, the user may be traveling and not expected to return for a week. In these implementations, the user may provide a neighbor or friend with credentials to access the native application. The neighbor or friend may be associated with the server that administers the native application. For example, the neighbor or friend's home may be monitored by an in-home monitoring system that communicates with the server that administers the native application. The neighbor or friend may enter the provided credentials to unlock the cables of the package holder device 104 to hold until the users return. In another example, the user may provide the neighbor or friend with a disarm code. The disarm code may be entered into the control panel of the monitoring system to unlock the cables of the package holder device 104. In some implementations, the package holder device 104 may have a panel on the landing pad that allows a user to enter an unlock code. The panel may include a keypad, a fingerprint reader, or a key option. For example, the neighbor or friend may enter the disarm code on the panel to unlock the cables of the device.

The package holder device 104 communicates the receipt of delivery of the package 120 when the package 120 is secured in the package holder device 104. The control unit 112 may communicate the receipt of the delivery of the package to the user device 118 of the user 116. The notification of receipt of delivery may be receive through the native monitoring system application, and may indicate the date and time of the package delivery. Based on the received data, the control unit 112 may command one or more devices throughout the monitored property to monitor the secured package. In some implementations, when a package is delivered to a package holder device 104, the control unit may communicate with a camera to capture images and/or video recordings of the package holder device 104 until the user collects the package. The images and/or video recordings may be captured periodically to ensure the safety of the package. The control unit may communicate the image and or video data to the user through the native monitoring system application on the user device.

In some implementations, the property 102 may not be monitored by an in-home monitoring system. In such examples, the location of the package holder device is constantly monitored by a GPS tracker associated with the package holder device. The GPS tracker may communicate its location to a central server that administers over several other package holder devices to constantly monitor the package holder device. When a package is secured in a package holder device, the package holder device may communicate the receipt of delivery to the central server, which in turn generates a notification to the user. The user may receive the notifications through an application used to track and monitor the package holder device associated with a particular user. The user may use the native application to unlock the cables of the package holder device. In the implementations where the property is monitored by an in-home monitoring system, the package holder devices may be GPS enabled.

The GPS tracker associated with the package holder device may be used to determine when the package holder device is being removed from the property. The package holder device may be configured with a geofence that limits the distance the package holder can be moved from the property before an alarm is generated. The package device may generate an audible alarm when moved beyond the threshold distance of the geofence. If the package holder device is stolen from the property, the GPS tracker can be used by law enforcement to locate the device.

The package holding device 104 may be configured to generate a distress signal if someone tampers with the package holder device 104. A thief may attempt to steal a package that is in a package holder device 104. The package holder device 104 is configured to detect when one or more of the securing cables are tampered with, and the speaker may generate an alarm based on detecting tampering of any of the cables. When tampering is detected, the package holder device 104 generates one or more RF signals to attempt to be detected by at least one nearby systems. For example, the GPS location of the package holder device 104 may be detected before the device is further tampered with or destroyed. Law enforcement may use the last known location to attempt to locate the stolen device.

Figure 2:
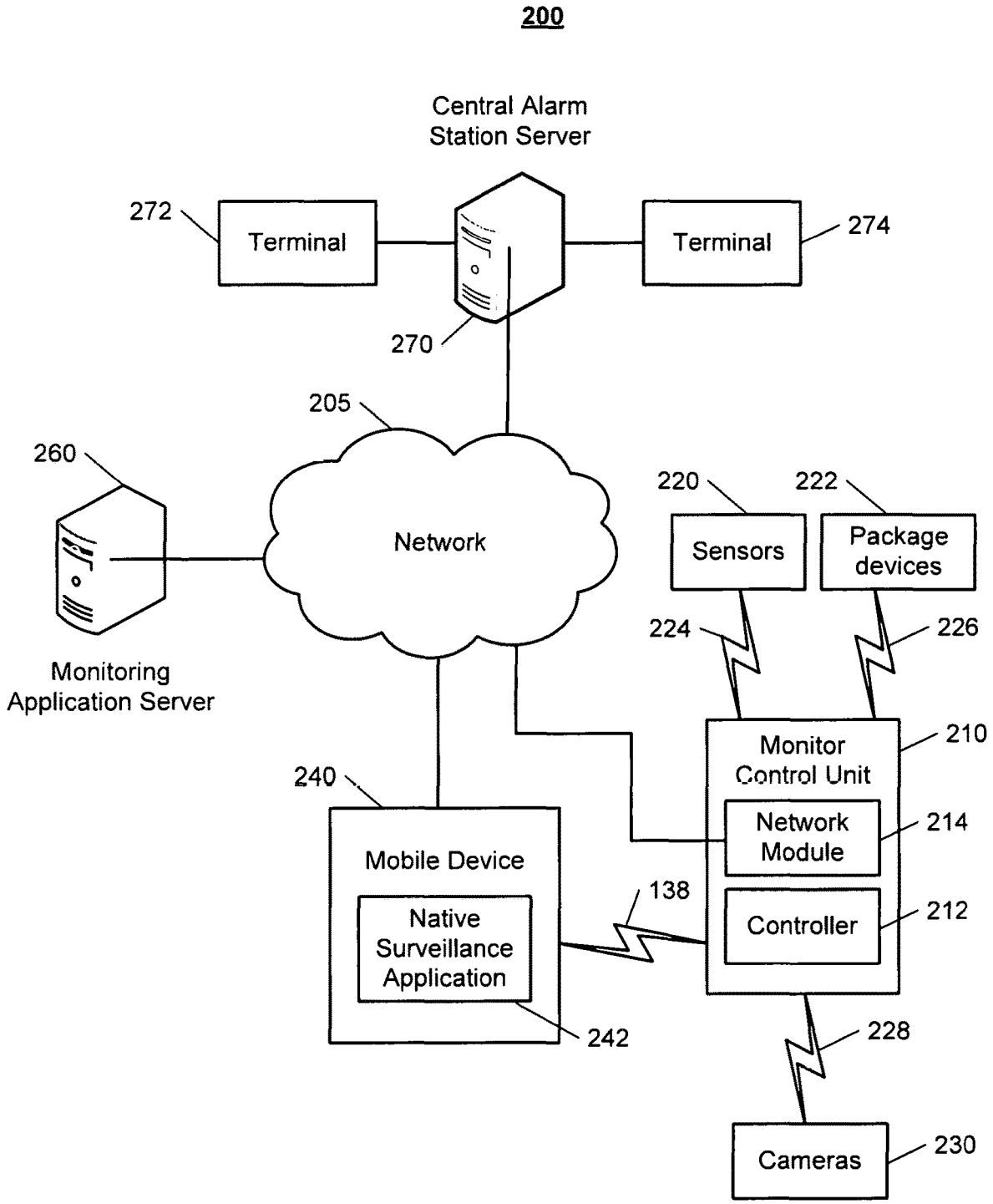
FIG. 2 illustrates an example of a monitoring system integrated with secured package holder devices.

FIG. 2 illustrates an example of a system 200 configured to monitor a property. The system 200 includes a network 205, a monitoring system control unit 210, one or more user devices 240, a monitoring application server 260, and a central alarm station server 270. The network 205 facilitates communications between the monitoring system control unit 210, the one or more user devices 240, the monitoring application server 260, and the central alarm station server 270. The network 205 is configured to enable exchange of electronic communications between devices connected to the network 205. For example, the network 205 may be configured to enable exchange of electronic communications between the monitoring system control unit 210, the one or more user devices 240, the monitoring application server 260, and the central alarm station server 270. The network 205 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data. Network 205 may include multiple networks or subnetworks, each of which may include, for example, a wired or wireless data pathway. The network 205 may include a circuit-switched network, a packet-switched data network, or any other network able to carry electronic communications (e.g., data or voice communications). For example, the network 205 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 205 may include one or more networks that include wireless data channels and wireless voice channels. The network 205 may be a wireless network, a broadband network, or a combination of networks including a wireless network and a broadband network.

The monitoring system control unit 210 includes a controller 212 and a network module 214. The controller 212 is configured to control a monitoring system (e.g., a home alarm or security system) that includes the monitor control unit 210. In some examples, the controller 212 may include a processor or other control circuitry configured to execute instructions of a program that controls operation of an alarm system. In these examples, the controller 212 may be configured to receive input from indoor door knobs, sensors, detectors, or other devices included in the alarm system and control operations of devices included in the alarm system or other household devices (e.g., a thermostat, an appliance, lights, etc.). For example, the controller 212 may be configured to control operation of the network module 214 included in the monitoring system control unit 210.

The network module 214 is a communication device configured to exchange communications over the network 205. The network module 214 may be a wireless communication module configured to exchange wireless communications over the network 205. For example, the network module 214 may be a wireless communication device configured to exchange communications over a wireless data channel and a wireless voice channel. In this example, the network module 214 may transmit alarm data over a wireless data channel and establish a two-way voice communication session over a wireless voice channel. The wireless communication device may include one or more of a GSM module, a radio modem, cellular transmission module, or any type of module configured to exchange communications in one of the following formats: LTE, GSM or GPRS, CDMA, EDGE or EGPRS, EV-DO or EVDO, UMTS, or IP.

The network module 214 also may be a wired communication module configured to exchange communications over the network 205 using a wired connection. For instance, the network module 214 may be a modem, a network interface card, or another type of network interface device. The network module 214 may be an Ethernet network card configured to enable the monitoring control unit 210 to communicate over a local area network and/or the Internet. The network module 214 also may be a voiceband modem configured to enable the alarm panel to communicate over the telephone lines of Plain Old Telephone Systems (POTS).

The monitoring system may include one or more package holder devices 222. Each of the one or more package holder devices 222 may include an electronic sensor that allows the package device to communicate with the monitor control unit 210. In some implementations, the one or more package holder devices 222 may communicate with the monitor control unit 210 through Bluetooth, Z-Wave, Wi-Fi, Image Sensor "Bolt" communication protocol, Lora, or other Powerline networks that operate over AC wiring. Other communication protocols may include, 802.11 "Wi-Fi" wireless Ethernet (e.g., using low-power Wi-Fi chipsets), Z-Wave, Zigbee, Bluetooth, "HomePlug" or other Powerline networks that operate over AC wiring, and a Category 5 (CAT5) or Category 6 (CAT6) wired Ethernet network. The package holder device may be shaped as a square landing pad, and include retractable cables that may be extended from each of the four sides of the landing pad. The package holder device may be configured to connect physically with another package device to allow for the delivery of one or more packages from one or more delivery men. The package holder device is a lightweight portable device that may be moved to different external areas around the monitored property. The landing pad of the package holder device may have the ability to absorb solar energy to power the device. In some examples, the package holder device may harvest energy from the pulling of the cables of the device. This energy may be used as a secondary energy source of the package holder device. The package holder device may also include a USB Type-C (or micro-USB) connection to allow a user to charge the device. The package holder device may include an LED status indicator. The status indicator LED may light up red when a package is secured in the device, may light up green when the package holder device is expecting a package, and may light yellow when the power levels on the device are running low. The status indicator may be configured by the user to light one or more different colors to indicate one or more other statuses. The package holder device may include a speaker that outputs the instructions for securing a package in the package holder device. The speaker may be used to facilitate a two-way conversation between a delivery man and the user.

The monitoring system may include multiple sensors 220. The sensors 220 may include a contact sensor, a motion sensor, a glass break sensor, or any other type of sensor included in an alarm system or security system. The sensors 220 also may include an environmental sensor, such as a temperature sensor, a water sensor, a rain sensor, a wind sensor, a light sensor, a smoke detector, a carbon monoxide detector, an air quality sensor, etc. The sensors 220 further may include a health monitoring sensor, such as a prescription bottle sensor that monitors taking of prescriptions, a blood pressure sensor, a blood sugar sensor, a bed mat configured to sense presence of liquid (e.g., bodily fluids) on the bed mat, etc. In some examples, the sensors 220 may include a radio-frequency identification (RFID) sensor that identifies a particular article that includes a pre-assigned RFID tag.

The one or more cameras 230 may be a video/photographic camera or other type of optical sensing device configured to capture images. For instance, the one or more cameras 230 may be configured to capture images of an area within a building monitored by the monitor control unit 210. The one or more cameras 230 may be configured to capture single, static images of the area and also video images of the area in which multiple images of the area are captured at a relatively high frequency (e.g., thirty images per second). The one or more cameras 230 may be controlled based on commands received from the monitor control unit 210.

The one or more cameras 230 may be triggered by several different types of techniques. For instance, a Passive Infra Red (PIR) motion sensor may be built into the one or more cameras 230 and used to trigger the one or more cameras 230 to capture one or more images when motion is detected. The one or more cameras 230 also may include a microwave motion sensor built into the camera and used to trigger the camera to capture one or more images when motion is detected. Each of the one or more cameras 230 may have a "normally open" or "normally closed" digital input that can trigger capture of one or more images when external sensors (e.g., the sensors 220, PIR, door/window, etc.) detect motion or other events. In some implementations, at least one camera 230 receives a command to capture an image when external devices detect motion or another potential alarm event. The camera may receive the command from the controller 212 or directly from one of the sensors 220.

In some examples, the one or more cameras 230 triggers integrated or external illuminators (e.g., Infra Red, Z-wave controlled "white" lights, lights controlled by the module 214, etc.) to improve image quality when the scene is dark. An integrated or separate light sensor may be used to determine if illumination is desired and may result in increased image quality.

The sensors 220, the package holder devices 222, and the cameras 230 communicate with the controller 212 over communication links 224, 226, and 228. The communication links 224, 226, and 228 may be a wired or wireless data pathway configured to transmit signals from the sensors 220, the package holder devices 222, and the cameras 230 to the controller 212. The communication link 224, 226, and 228 228 may include a local network, such as, 802.11 "Wi-Fi" wireless Ethernet (e.g., using low-power Wi-Fi chipsets), Z-Wave, Power Over Ethernet (POE), Zigbee, Bluetooth, "HomePlug" or other Powerline networks that operate over AC wiring, and a Category 5 (CAT5) or Category 6 (CAT6) wired Ethernet network.

The monitoring application server 260 is an electronic device configured to provide monitoring services by exchanging electronic communications with the monitor control unit 210, and the one or more user devices 240, over the network 205. For example, the monitoring application server 260 may be configured to monitor events (e.g., alarm events) generated by the monitor control unit 210. In this example, the monitoring application server 260 may exchange electronic communications with the network module 214 included in the monitoring system control unit 210 to receive information regarding events (e.g., alarm events) detected by the monitoring system control unit 210. The monitoring application server 260 also may receive information regarding events (e.g., alarm events) from the one or more user devices 240. In some implementations, any activity performed by the monitoring application server 260 may be performed by the monitor control unit 210, and any activity performed by the monitor control unit 210 may be performed by the monitoring application server 260.

The one or more user devices 240 are devices that host and display user interfaces. The user device 240 may be a cellular phone or a non-cellular locally networked device with a display. The user device 240 may include a cell phone, a smart phone, a tablet PC, a personal digital assistant ("PDA"), or any other portable device configured to communicate over a network and display information. For example, implementations may also include Blackberry-type devices (e.g., as provided by Research in Motion), electronic organizers, iPhone-type devices (e.g., as provided by Apple), iPod devices (e.g., as provided by Apple) or other portable music players, other communication devices, and handheld or portable electronic devices for gaming, communications, and/or data organization. The user device 240 may perform functions unrelated to the monitoring system, such as placing personal telephone calls, playing music, playing video, displaying pictures, browsing the Internet, maintaining an electronic calendar, etc.

The user device 240 includes a native surveillance application 242. The native surveillance application 242 refers to a software/firmware program running on the corresponding mobile device that enables the user interface and features described throughout. The user device 240 may load or install the native surveillance application 242 based on data received over a network or data received from local media. The native surveillance application 242 runs on mobile devices platforms, such as iPhone, iPod touch, Blackberry, Google Android, Windows Mobile, etc. The native surveillance application 242 enables the user device 140 to receive and process image and sensor data from the monitoring system.

The central alarm station server 270 is an electronic device configured to provide alarm monitoring service by exchanging communications with the monitor control unit 210, the one or more user devices 240, and the monitoring application server 260 over the network 205. For example, the central alarm station server 270 may be configured to monitor alarm events generated by the monitoring system control unit 210. In this example, the central alarm station server 270 may exchange communications with the network module 214 included in the monitor control unit 210 to receive information regarding alarm events detected by the monitor control unit 210. The central alarm station server 270 also may receive information regarding alarm events from the one or more user devices 240.

The central alarm station server 270 is connected to multiple terminals 272 and 274. The terminals 272 and 274 may be used by operators to process alarm events. For example, the central alarm station server 270 may route alarm data to the terminals 272 and 274 to enable an operator to process the alarm data. The terminals 272 and 274 may include general-purpose computers (e.g., desktop personal computers, workstations, or laptop computers) that are configured to receive alarm data from a server in the central alarm station server 270 and render a display of information based on the alarm data. For instance, the controller 212 may control the network module 214 to transmit, to the central alarm station server 270, alarm data indicating that a sensor 220 detected a door opening when the monitoring system was armed. The central alarm station server 270 may receive the alarm data and route the alarm data to the terminal 272 for processing by an operator associated with the terminal 272. The terminal 272 may render a display to the operator that includes information associated with the alarm event (e.g., the name of the user of the alarm system, the address of the building the alarm system is monitoring, the type of alarm event, etc.) and the operator may handle the alarm event based on the displayed information.

In some implementations, the terminals 272 and 274 may be mobile devices or devices designed for a specific function. Although FIG. 2 illustrates two terminals for brevity, actual implementations may include more (and, perhaps, many more) terminals.

In some implementations, the one or more user devices 240 communicate with and receive monitoring system data from the monitor control unit 210 using the communication link 238. For instance, the one or more user devices 240 may communicate with the monitor control unit 210 using various local wireless protocols such as Wi-Fi, Bolt, Lora, Bluetooth, Z-Wave, Zigbee, "HomePlug," or other Powerline networks that operate over AC wiring, or Power over Ethernet (POE), or wired protocols such as Ethernet and USB, to connect the one or more user devices 240 to local security and automation equipment. The one or more user devices 240 may connect locally to the monitoring system and its sensors and other devices. The local connection may improve the speed of status and control communications because communicating through the network 205 with a remote server (e.g., the monitoring application server 260) may be significantly slower.

Although the one or more user devices 240 are shown as communicating with the monitor control unit 210, the one or more user devices 240 may communicate directly with the sensors and other devices controlled by the monitor control unit 210. In some implementations, the one or more user devices 240 replace the monitoring system control unit 210 and perform the functions of the monitoring system control unit 210 for local monitoring and long range/offsite communication.

Figure 3:
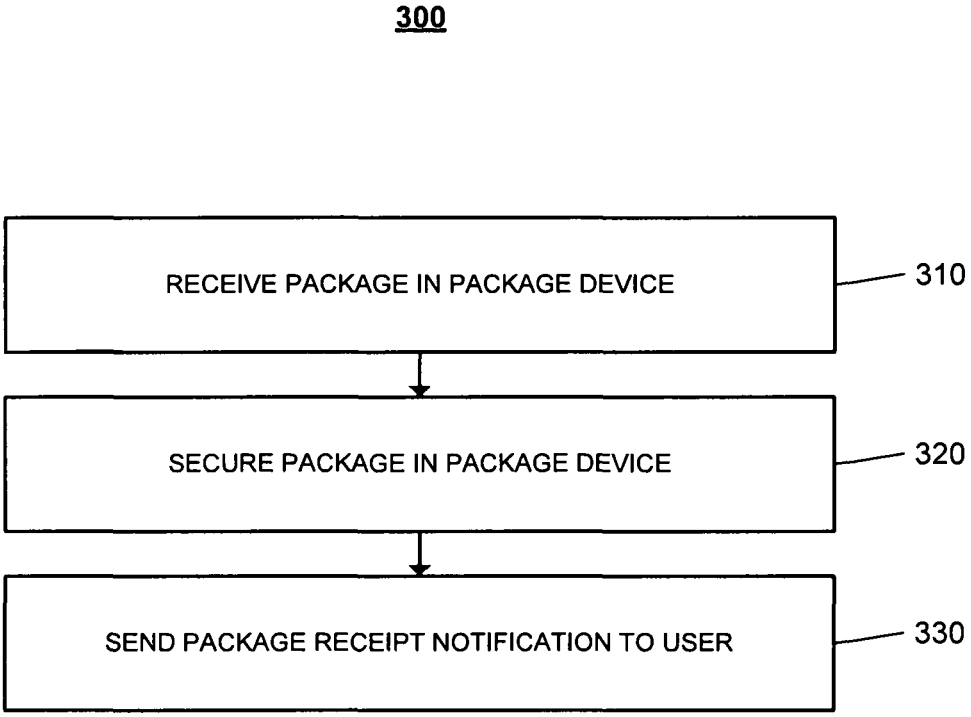
FIG. 3 is a flow chart of an example process for sending a package receipt notification to a user.

FIG. 3 illustrates an example process 300 for sending a package receipt notification to a user. The package holder device receives a package (310). A delivery man may approach a monitored property to deliver a package. The delivery man may read the directions for securing the package on the landing pad of the package holder device. In some examples, the delivery man may press a speaker button on the package holder device to prompt the speaker to audibly output the step by step directions for securing the package into the package holder device. In other examples, an external camera at the monitored property may detect a delivery man approaching the monitored property, and may communicate with the control unit to prompt the package holder device to output the securing instructions through the speaker. In yet another example, the secured package holder device may include a motion sensor that detects a delivery man approaching, and outputs the securing instructions from the speaker based on the detected motion.

The delivery man secures the package in the package holder device (320). The secured package holder device may be shaped as a square landing pad, and may include cables that extend from each of the sides of the landing pad. In some examples, the landing pad of the package device may be shaped as a rectangle, or may have any other suitable shape. The delivery man may place the package on the landing pad of the package holder device, and may extend the two lengthwise cables from the sides of the landing pad around the package. The ends of the two lengthwise cables may have clip ends that allow the delivery man to clip the ends of the cables around the package. The cables around the package may automatically tighten around the package when the ends are clipped together. The ends of the two widthwise cables may have buckle ends that allow the delivery man to buckle the ends of the cables around the package. In some examples, the ends of the cables may have magnetic ends that lock into place as the package is secured n the package holder device. The lengthwise and the widthwise cables may form a cross at the top of the package when both pairs of cables are secured. The LED on the packing device may light red when the package is placed in the packing device and the cables are securely strapped around the package.

In some examples, one or more packages may be delivered to the monitored property. A user may expect one or more packages while away, and may have one or more package holder devices placed on an exterior of the monitored property for delivery. In some implementations, the one or more package holder devices may be configured to connect to each other. For example, the one or more package holder devices may be configured to physically connect with each other. In some examples the package holder devices may have different varying sizes to accommodate different sized packages. For example, there may be small, medium, and large sized package holder devices. The small and medium sized package holder devices may still accommodate larger packages by having cables that can extend.

The control unit sends a package receipt notification to user (330). When the package is secured in the package holder device, the device communicates this information to the control unit. The package holder device may communicate the date and time the package was secured in the package holder device. The control unit sends a notification to the client device of a user associated with the monitored property. The notification may include the date and the time of the delivery of the package. For example, the control unit may send an SMS message the user's cellular phone.

Figure 4:
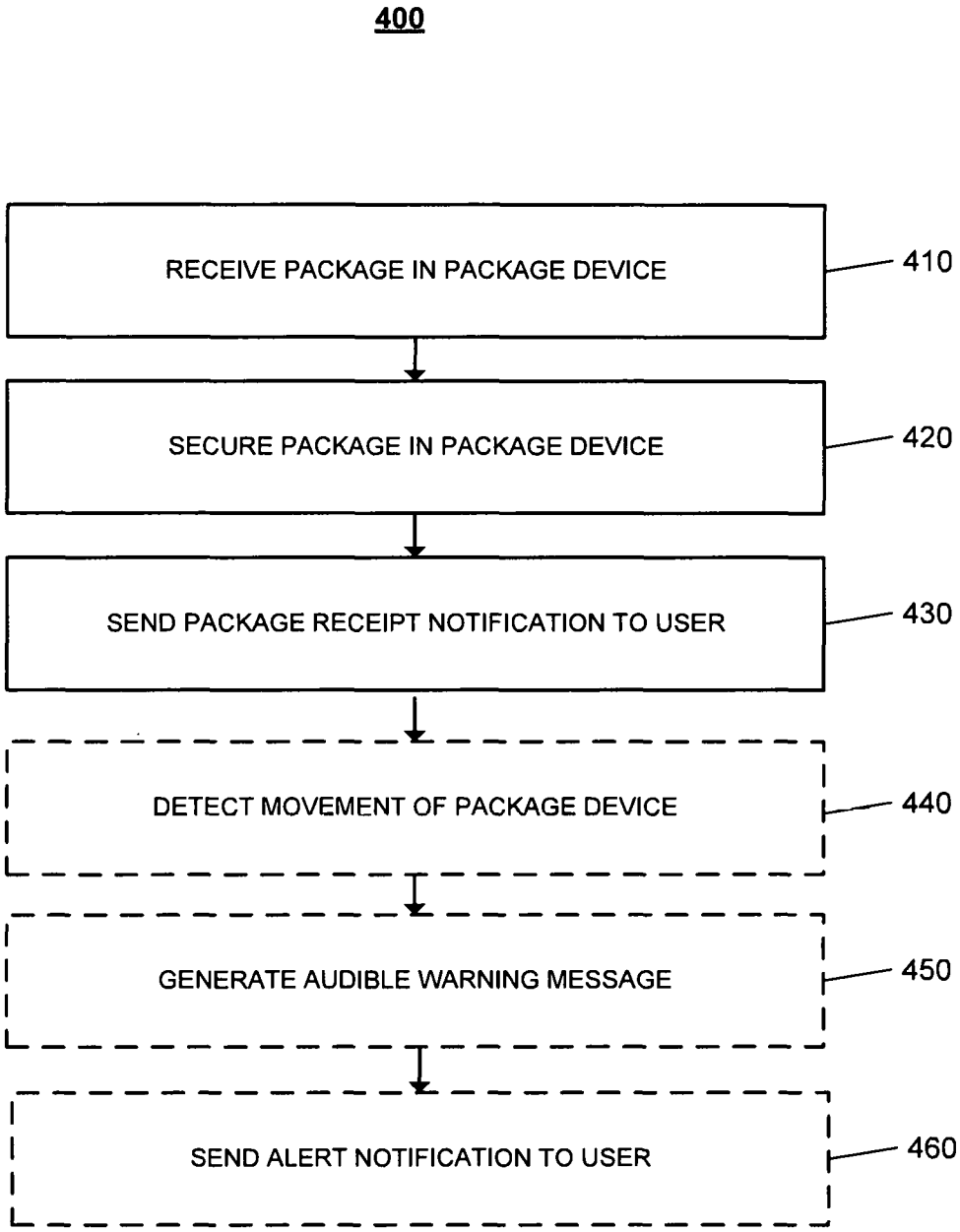
FIG. 4 illustrates an example process for sending an alert notification to a user.

FIG. 4 illustrates an example process 400 for sending an alert notification to a user. The package holder device receives a package (410). As described earlier, a delivery man may approach a monitored property to deliver a package. The delivery man may read the directions for securing the package on the landing pad of the package holder device. In some examples, the delivery man may press a speaker button on the package holder device to prompt the speaker to audibly output the step by step directions for securing the package into the package holder device. In other examples, an external camera at the monitored property may detect a delivery man approaching the monitored property, and may communicate with the control unit to prompt the package holder device to output the securing instructions through the speaker. In yet another example, the package holder device may include a motion sensor that detects a delivery man approaching, and outputs the securing instructions from the speaker based on detected motion.

The delivery man secures the package in the package holder device (420). The package holder device may be shaped as a square landing pad, and may include cables that extend from each of the sides of the landing pad. In some examples, the landing pad of the package device may be shaped as a rectangle, or may have any other suitable shape. The delivery man may place the package on the landing pad of the package holder device, and may extend the two lengthwise cables from the sides of the landing pad around the package. The ends of the two lengthwise cables may have clip ends that allow the delivery may to clip the ends of the cables around the package. The cables around the package may automatically tightened around the package when the ends are clipped together. The ends of the two widthwise cables may have buckle ends that allow the delivery man to buckle the ends of the cables around the package. In some examples, the ends of the cables may have magnetic ends that clamp into place as the package is secured n the package device. The lengthwise and the widthwise cables may form a cross at the top of the package when both pairs of cables are secured. The LED on the packing device may light red when the package is placed in the packing device and the cables are securely strapped around the package.

The control unit sends a package receipt notification to user (430). When the package is secured in the package holder device, the package holder device communicates this information to the control unit. The package holder device may communicate the date and time the package was secured in the device. The control unit sends a notification to the client device of a user associated with the monitored property. The notification may include the date and the time of the delivery of the package. For example, the control unit may send a notification through the monitoring system native application.

The package holder device detects movement (440). The package holder device may be equipped with a gyroscope, accelerometer, and a gravity sensor to allow the package holder device to detect rotational direction changes of the device. When the movement of the package holder device exceeds the threshold movement of the gyroscope, the package holder device may communicate to the control unit to command a camera to capture video data. In some examples, when the package holder device detects movement and communicates the detected movement to the control unit, the control unit may command one or more external cameras to capture video of the area around the monitored property. In some implementations, the control unit may communicate with a monitoring server that is in communication with one or more control units of neighboring properties. The monitoring server may communicate to the one or more other control units to capture video recordings of the areas surrounding each of the neighboring properties.

The package holder device generates an audible warning message (450). The package holder device generates an audible warning message when the gyroscope detects the movement exceeds a threshold. For example, the speaker of the package holder device may generate an audible alarm when movement is detected. In another example, the speaker of the package holder device may output a command to return the device to its original position. The command from the speaker may include a time limit for moving the package holder device back to its original position before an alarm is sounded. For example, the command may indicate that an alarm will be sounded if the device is not moved in the next ten seconds.

The control unit sends an alert notification to the user (460). The package holder device communicates the detected movement of the device to the control unit, and the control unit may send a notification of the detected movement to the user. The notification may be sent to the mobile device of the user as a message. In some examples, the notification may be sent as an alert to the user through the monitoring server native application. The notification may include the time of detected movement. In some implementations, the notification may include a link to the real time video recordings captured from the one or more cameras at the monitored property.

Figure 5:
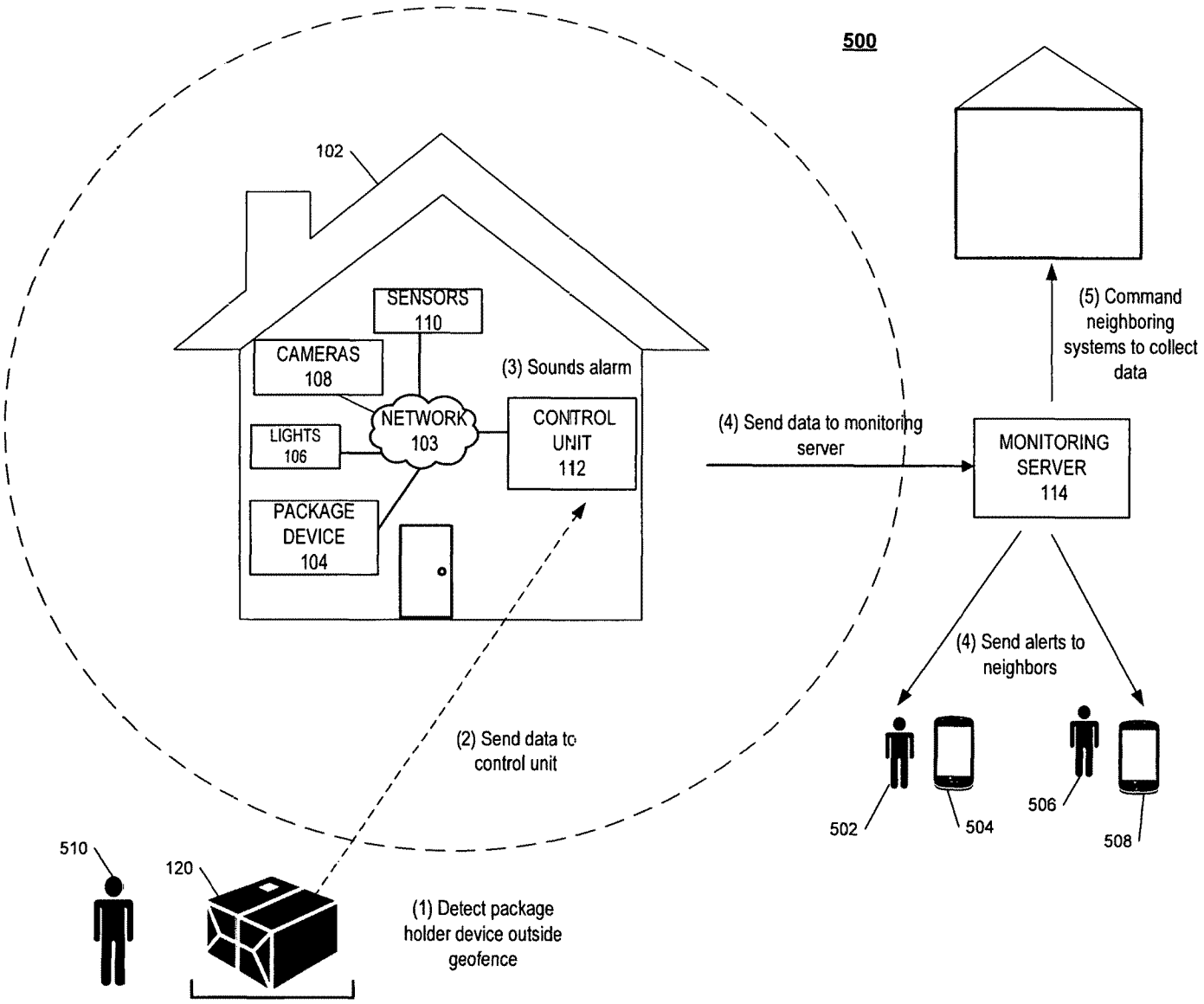
FIG. 5 illustrates an example of a system for alerting neighboring monitoring systems when an alarm condition is detected.

FIG. 5 illustrates an example of a monitoring system 500 integrated with a secured package holder device 104. As shown in FIG. 5, a package 120 is delivered to the monitored property 102 and is secured in a package holder device 104. A delivery man may approach the monitored property 102 to deliver a package, and may read the directions to secure the package into the package device off the landing pad of the device. In some examples, the package may be dropped off by a friend or a neighbor of the user associated with the monitored property 102. For example, the neighbor may have borrowed a tool kit from the user and may return the tool kit by securing the tool kit into the package holder device 104. The package may be secured in the package holder device 104 by extending cables from each of the sides of the package holder device and securing opposite ends of the cables together. For example, the extendable cables may strap around the package and the first two ends may be clipped together, and the second two ends may be buckled together to secure the package.

When the package 120 is secured in the package holder device 104, the LED on the package holder device 104 may light red indicating that the device is in the armed status. The package holder device then communicates to the control unit 112 that the package is secured in the device 104. In some implementations, the control unit 112 may command an external camera associated with the package holder device to capture video data of package holder device 104 based on receiving notification that a package is secured in the device. The camera may continue to acquire video data until the package is removed from the package holder device by the user associated with the monitored property. For example, the package may be removed from the package holder device when the user unlocks the straps through the native application. In some examples, the external camera associated with the package holder device 104 may be prompted to start retrieving video data of the package holder device when the delivery man extends the first cable from the device. In these examples, the package holder device 104 may communicate to the control unit 112 that someone is handling the package holder device 104. When the control unit 112 prompts the external camera to start capturing video data, the control unit 112 may also send a notification to the user associated with the monitored property 102, notifying the user of the handling of the package holder device 104. The user may access the live video data acquired from the external camera through the native application.

As illustrated in FIG. 5, when the package holder device 104 is moved outside of a predetermined geofence area, the control unit 112 sounds an alarm. The package holder device 104 may include a gyroscope, accelerometer, and/or a gravity sensor, that are configured to measure movement of the device, and may include a GPS that tracks its GPS location. The user associated with the monitored property 102 may configure a geofence around the property, and the package holder device 104 may sound an alarm if the GPS determines that the package holder device was moved outside of the geofence. For example, the user may set a geofence radius of ten feet around the property. The user may have the ability to configure different setting for the geofence radius through the native application.

In some examples, the control unit 112 may command the monitoring system at the property to generate an audible alarm. In some examples, the package holder device 104 may generate an alarm through its speaker. In these examples, the speaker on the package holder device may generate a beeping sound. The speaker on the package device may in some examples generate a command warning message to the user 510 that moved the package holder device 104 outside of the geofence. For example, the speaker may command the user 510 to return the package device to the property 102. In some implementations, the gyroscope of the package holder device may detect that the device has been moved. The speaker on the package holder device may audibly announce that the package holder device may be moved, but if moved more than a certain distance the alarm will sound. For example, a delivery man may move the package holder device when attempting to secure a package, the speaker on the package device may announce that the device can be moved but if moved more than five feet an alarm will sound. In some examples, the LED on the package holder device may flash red when the package holder device is being moved, and the speed of the flashing may increase as the package device is moved further from the property.

The control unit 112 at the monitored property 102 may communicate the alarm condition to an external monitoring server 114. The monitoring server 114 may be in communication with several control units from several monitored properties. The monitoring server 114 may communicate the received alarm condition data to one or more other control units from neighboring properties. The control units of each of the one or more neighboring properties may prompt external cameras to begin capturing video and image data in the hopes of capturing video evidence of a thief holding the package and or the package holder device.

The monitoring server 114 may generate and send notifications to the mobile devices 504 and 508 of the users 502 and 506 associated with each of the one or more neighboring properties. The notification may include the detected alarm condition and may indicate to the users which camera at their property is capturing video and image data. The monitoring server 114 may also communicate the detected alarm condition to law enforcement.

Figure 6:
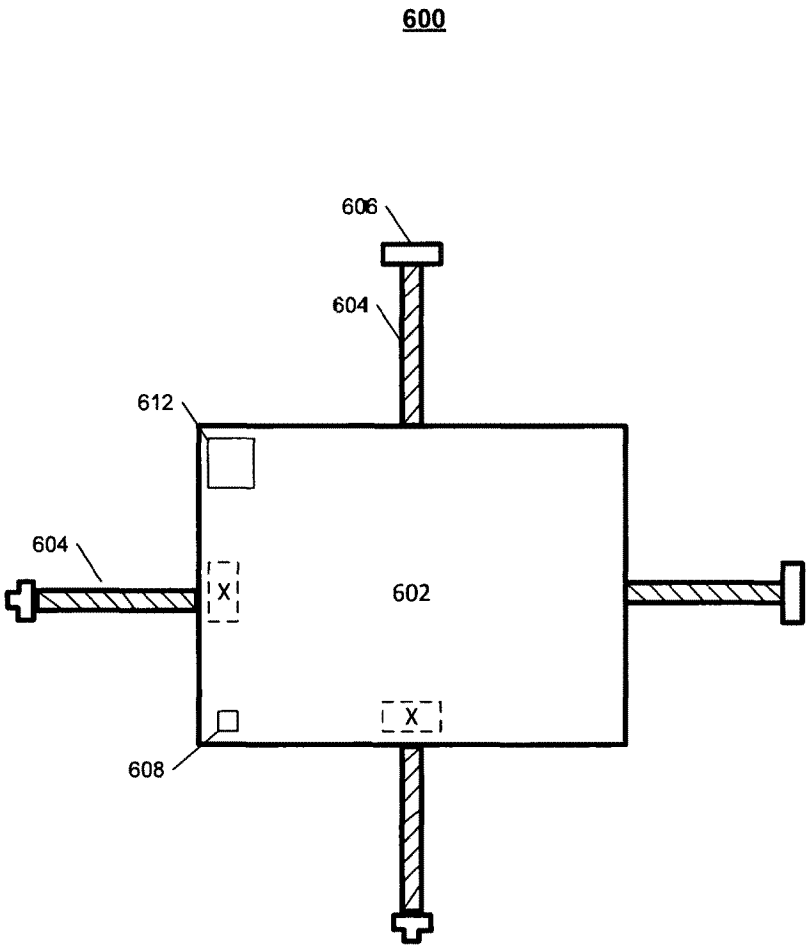
FIG. 6 illustrates an example package holder device

FIG. 6 illustrates an example package holder device 602. As illustrated, the package holder device 602 may be shaped as a rectangular landing pad. In some examples, the landing pad of the package holder device 602 may be shaped as a square. The landing pad of the package holder device 602 may have cables 604 that extend from each of the four sides. The ends 606 of each of the four cables 604 may be equipped with either a buckle or a clip to lock the cables together. The package holder device 602 may include a cable retractor knob 610 that a user may press to retract the cables 604. The package holder device 602 may include an LED status indicator 608. The status indicator LED may light up red when a package is secured in the device, may light up green when the package holder device is expecting a package, and may light yellow when the power levels on the device are running low. The package holder device 602 may include a speaker 612 that outputs the instructions for securing a package in the package holder device 602.

Figure 7:
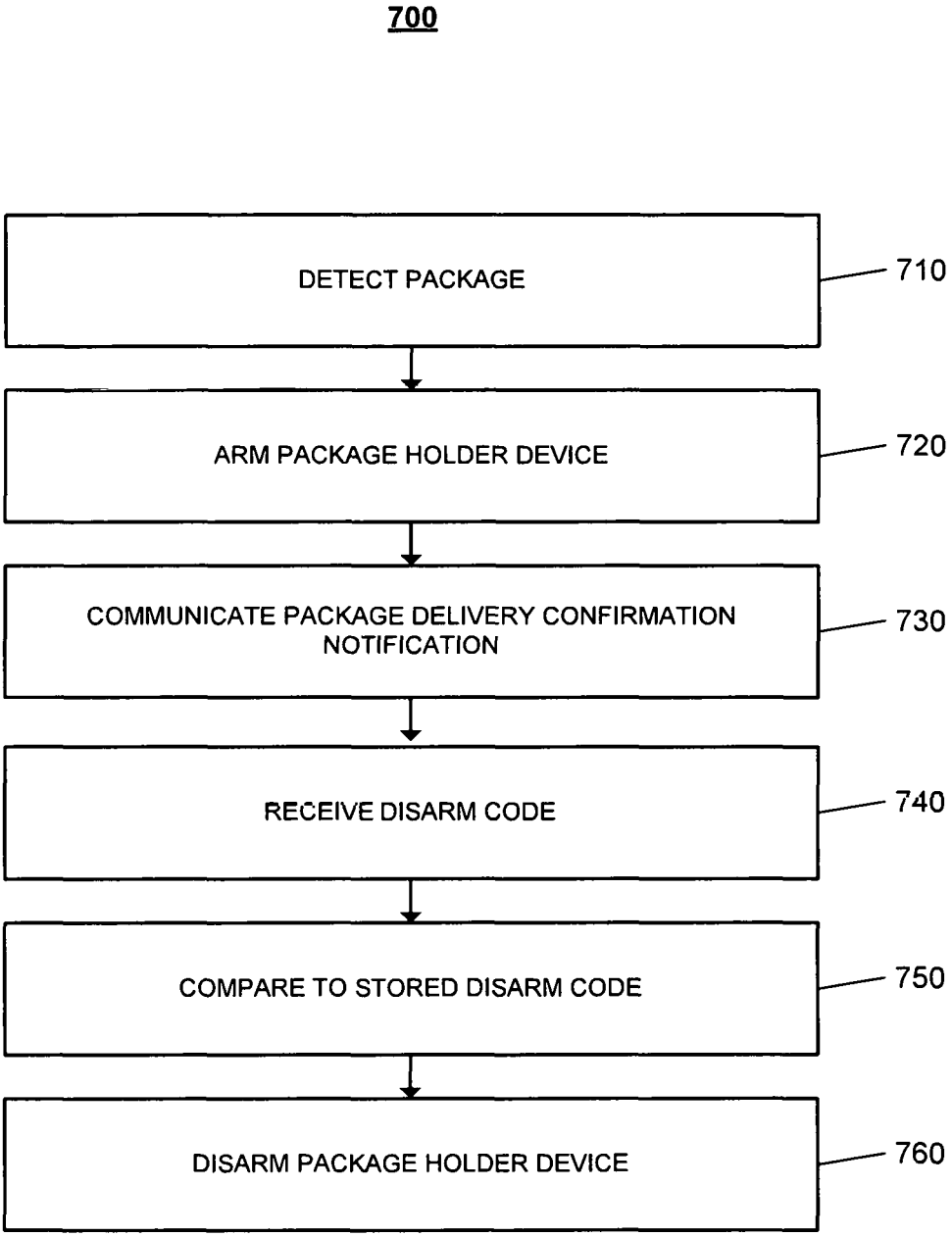
FIG. 7 illustrates an example process for disarming the package holder device.

FIG. 7 illustrates an example process 700 for disarming a package holder device. The package holder device detects that a package has been placed on and secured by the package holder device (710). A delivery man may approach a monitored property that includes a package holder device to deliver a package. The delivery man may place the package on the landing pad of the package holder device, and may extend the arms of the device around the package to secure the package on the package holder device.

The package holder device includes arms that extend from each of the four sides of the landing pad of the device. The arms that extend from the opposite sides of the device may have clip ends that are complimentary to each other and that allow the delivery man to clip the opposite arms together around the package. The delivery man may extend the other two opposite arms around the package and the ends of the other two arms may also be clipped around the package. The arms of the package holder device may automatically tighten around the package when the ends of the arms are clipped together. In some examples, the end of the arms may have clip ends, buckle ends, magnetic ends, or any other suitable fastening mechanism that allows the arms of the device to secure the package.

In some implementations, the delivery man may read instructions for securing a package into the package holder device from the landing pad of the package holder device. In other examples, the delivery man may push a button on the package holder device to prompt the speaker of the device to output the instructions for securing the package into the device. In yet another example, the speaker of the package holder device may automatically output instructions for securing a package into the package holder device when a motion sensor detects motion near the package holder device.

In some examples, the motion sensor may be a motion sensor integrated into the monitoring system at the monitored property, and that is configured to detect motion in the vicinity. In other examples, the package holder device may include a motion sensor that is configured to detect motion in the vicinity to the device. The motion sensor may detect motion that is within a threshold radial distance from the package holder device. For example, the motion sensor may detect motion that is within five feet of the package holder device.

When the monitoring control unit receives a shipping notification that indicates a package is expected to be delivered at the monitored property, the monitoring control unit may decrease the threshold distance for trigging motion in the vicinity of the package holder device. For example, the motion sensor may detect motion that is within two feet of the package holder device. The monitoring control unit may decrease the threshold distance for trigging motion for any period of time. In some examples, the threshold distance may be decreased from 8:00 AM to 9:00 PM on the days of an expected delivery. When the monitoring control unit receives data indicating motion near the package holder device, the monitoring control unit may generate a voice command that includes the instructions for securing the package into the package holder device. The monitoring control unit communicates the voice command to the package holder device to output the directions for securing a package in the device when the motion data exceeds the increased motion threshold.

In some implementations, the shipping notification may indicate package size data that indicates the size of the package. When the monitoring control unit receives a shipping notification that indicates the package is oversized, the monitoring control unit generates a voice command that includes instructions for securing the oversized package into the package holder device. The instructions for securing an oversized package may include instructing the user to press a tab on the package holder device that causes each of the one or more arms to extend an additional length out of the device. In some implementations, the package holder device may include two additional arms for securing oversized packages, in these implementations, the package holder device may output instructions for accessing the two additional arms and securing around the oversized package.

In some implementations, the monitoring control unit receives image data from a camera that is configured to capture image data of the area in the vicinity of the package holder device. The camera may be integrated into the monitoring system at the monitored property. The monitoring control unit receives image data captured by the camera, and the monitoring control unit analyzes the data. When the monitoring control unit determines that a person holding a package is within the vicinity of the package holder device, the monitoring control unit generates a voice command that includes instructions for securing the package into the package holder device. The monitoring control unit communicates the voice command to the package holder device, and the package holder device outputs the voice command of the instructions to secure the package.

The monitoring control unit arms the package holder device (720). The monitoring control unit arms the package holder device in response to detecting that a package has been placed on and secured into the device. The package holder device may communicate with the monitoring control unit when the arms of the device are extended and locked around a package, and the monitoring control unit in turn arms the device. A status indicator LED on the package holder device may switch from lighting green to red when the package holder device is armed.

The monitoring control unit communicates a package delivery confirmation notification to a user device of a resident of the monitored property (730). The confirmation notification may include the time and date of the delivery. In some examples, the notification may be communicated as an in-application notification through the monitoring system native application.

The monitoring control unit receives a disarm code (740). In some implementations, a user may disarm the package holder device by using a monitoring system disarm code. The monitoring system disarm code is the code used to arm and disarm the alarm system at the monitored property. The user may retrieve the armed package holder device when returning to the monitored property, and may enter the monitoring system disarm code to simultaneously disarm the monitoring system and the package holder device. For example, the user may enter the monitoring system disarm code into a control panel of the monitoring system. In another example, the user may enter the monitoring system disarm code into the monitoring system native application on the user's mobile device.

In some implementations, the user may disarm the package holder device by using a package holder device disarm code. The package holder device disarm code may be a code configured by the resident user that is specifically used to arm and/or disarm the package holder device. In some examples, where the package holder device includes a keypad, the user may enter the package holder device disarm code directly into the keypad on the device to disarm the device. In another example, the user may enter the package holder device disarm code into the monitoring system native application on the user's mobile device. In yet another example, the user may enter the package holder device disarm code into the control panel of the monitoring system to disarm the device. The package holder device disarm code may be used to simultaneously disarm the package holder device and the monitoring system at the property.

The monitoring control unit compares the received code to a stored disarm code (750). The monitoring control unit may have one or more configured disarm codes stored in its memory. The resident user of the monitored property may access the monitoring system native application on the user's device to configure the one or more disarm codes. The user may configure a monitoring system disarm code that may be used to disarm the monitoring system when the monitoring system is in an armed state. The user may configure the package holder device to be simultaneously disarmed when the monitoring system disarm code is used to disarm the monitoring system. The user may configure a disarm code specific to disarm the package holder device. The package holder device disarm code and the monitoring system disarm code may be stored in memory at the monitoring control unit. When the monitoring control unit receives a disarm code, the monitoring control unit compares the received disarm code to the one or more stored disarm codes to determine whether a valid disarm code was entered.

The monitoring control unit disarms the package holder device (760). When the monitoring control unit determines that the received disarm code matches a stored disarm code, the monitoring control unit determines that the received code is a valid disarm code. Based on determining the received disarm code is valid, the monitoring control unit commands the package holder device to unlock the one or more arms of the package holder device for the user to retrieve the package. The status indicator LED on the package holder device lights green when the package holder device is disarmed. In some implementations, the resident may disarm the package holder device by providing biometric information or other identifying or unique data to the monitoring control unit or the package holder device to disarm the package holder device.

In some implementations, the package holder device may automatically disarm when an armed package holder device is moved to the inside of the monitored property. The package holder device may include an accelerometer and a gyroscope which are used to detect when the package holder device is moved. When the package holder device is moved, the accelerometer data and the gyroscope data is communicated to the monitoring control unit. The monitoring control unit may prompt the package holder device to report its GPS location based on receiving accelerometer and gyroscope data from the package holder device. The monitoring control unit commands the one or more arms of the package holder device to unlock based on the GPS location of the package holder device indicating that the device is on an inside of the monitored property.

In some implementations, when the monitored property is armed stay or unarmed, the monitoring control unit assumes that the property is occupied, and increases a movement threshold for the package holder device. In some implementations, the monitoring control unit may determine an occupancy status of the property based on data from motion detectors located inside and/or around the property and/or based on geo-location data received from devices that belong to residents of the property. The movement threshold may be an accelerometer and gyroscope threshold that is compared to the received accelerometer and gyroscope data to determine whether the package holder device moved. When the property is occupied, a user is likely to move an armed package holder device into the property to access the delivered package. The monitoring control unit increases the movement threshold to ensure that the movement into the property does not trigger the package holder device to generate an audible alarm or a warning message.

In some implementations, when the monitoring system is armed away, the monitoring control unit assumes the property is unoccupied and decreases the movement threshold for the package holder device. When the property is unoccupied, the monitoring control unit assumes that the package holder should not be moved, and decreases the movement threshold to detect any movement. The package holder device may generate an audible warning message when the package holder device detects the device has been moved to a location other than an inside of the monitored property. When the package holder device communicates accelerometer and gyroscope data that indicate movement to the monitoring control unit, the monitoring control unit may prompt the package holder device to reports its GPS location. The monitoring control unit may prompt the package holder device to generate an audible alarm when the GPS location of the package holder device is outside of a threshold distance from the monitored property.

In some implementations, the monitoring control unit may generate a notification to the resident user mobile device indicating the package holder device is outside of the threshold distance. The notification may include the GPS location of the package holder device. In some examples, when the monitoring control unit determines the package holder device is located outside of the threshold distance the monitoring control unit provides an instruction to one or more other monitoring systems in the vicinity of the monitored property to activate one or more image capturing devices. For example, a monitoring system of a property down the street may activate an outdoor camera to try to capture an image of the package holder device. In another example, a monitoring system of a property down the street may activate a drone that travels around the neighborhood to try to capture an image of the package holder device. The drone may be configured to track a signal form the package holder device such as an audible signal, an ultrasonic signal, a signal that indicates a location of the package holder device, etc. In some implementations, the drone may be a neighborhood drone that is assigned to a portion of the neighborhood that includes the property of the package holder device.

In some implementations, when the package holder device determines it is outside of a threshold distance from the monitored property, the package holder device may generate an audible alarm. For example, a burglar may steal the package holder device, and move the device outside of a threshold distance from the monitored property, the package holder device may generate an alarm from a speaker on the device in response to determining it is outside of the threshold distance.

In some implementations, the resident may receive a notification indicating that bad weather, for example, rain, may be in the area of the package holder device and that the package holder device has a package secured. The package holder device may include a sensor that detects rain or other bad weather. The package holder device may indicate to the monitoring system that the package holder device detects rain and the monitoring system may notify the resident.

In some implementations, the package holder device may be securing a package and another package is delivered. The delivery person may attempt to secure the new package to the package holder device. During this time, the monitoring system may provide a notification to the user to ask the user for guidance for how to receive the new package. Some options for delivery, may be to request that the delivery person redelivery the package another day, leave the new package outside of the package holder, or disarm the package holder device and allow the delivery person to secure the new package and removed the other package from the package holder device. In some implementations, the monitoring system may determine an action without requesting instructions from the resident.

In some implementations, the package holder device may be configured to detect an animal disturbing a secured package or the package holder device without a package. The package holder device may use a motion sensor to detect likely animal disturbances. In some implementations, the monitoring system may analyze sensor data to determine whether an animal is disturbing the package holder device. In instances where an animal is detected, the package holder device or monitoring system may emit a sound to disrupt the animals such as an ultrasonic frequency that may be inaudible to humans.

In some implementations, the delivery person may be unable to secure a package to the package holder device because a package may be too big or the package holder device fails. In this instance, the monitoring system may notify the user. The user may provide instructions to reattempt delivery another day, leave the package outside of the package device holder, or reset the package device holder. In some implementations, the monitoring system or package device holder may provide the instructions based on instructions previously provided by the user.

In some implementations, the package holder device may output instructions for the delivery person to follow. The instructions may be based on the status of any residents in the home as detected by the monitoring system. For example, if the monitoring system detects that nobody is home, then the instructions may be to deliver directly to the package holder device without knocking or ringing the doorbell. As another example, if somebody is home, then the instructions may be to attempt to knock or ring the doorbell. In nobody answers, then the instructions may be to delivery to the package holder device. If somebody is home, then the resident may set the instruction to "do not disturb." In this instance, the instruction would be to deliver to the package holder device without knocking or ringing the doorbell. This may be helpful if a baby is sleeping inside the property.

The described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

The invention claimed is:

1. A monitoring system that is configured to monitor a property, comprising:

a package holder device that is configured to:

receive a package at the package holder device;

secure the package; and arm the package holder device;

generate location data that indicates a location of the package holder device; and a monitoring control unit that is configured to:

receive, from the package holder device, data indicating that the package holder device secured the package and that the package holder device is armed;

communicate, to a user device of a resident of the property, a package delivery confirmation notification indicating that the package holder device received and secured the package;

receive, from the package holder device, the location data that indicates the location of the package holder device;

determine that the location of the package holder device is within a building of the property; and based on determining that the location of the package holder device is within the building of the property, disarm the package holder device.

2. The system of claim 1, wherein the package holder device is configured to:

receive a disarm code;

compare the received disarm code to a stored disarm code;

based on comparing the received disarm code to the stored disarm code, determine that the received disarm code matches the stored disarm code; and disarm the package holder device by disarming the pack based on determining that the location of the package holder device is within the building of the property and based on determining that the received disarm code matches the stored disarm code.

3. The system of claim 2, wherein the monitoring control unit is configured to:

compare the received disarm code to the stored disarm code by comparing the received disarm code to a disarm code that disarms the monitoring system while the monitoring system is in an armed state, and disarm the package holder device by disarming the package holder device based on the received disarm code matching the disarm code that disarms the monitoring system while the monitoring system is in an armed state.

4. The system of claim 2, wherein the monitoring control unit is configured to:

compare the received disarm code to the stored disarm code by comparing the disarm code to a disarm code that disarms the package holder device and that does not disarm the monitoring system while the monitoring system is in an armed state, and disarm the package holder device by disarming the package holder device based on the received disarm code matching the disarm code that disarms the package holder device and that does not disarm the monitoring system while the monitoring system is in an armed state.

5. The system of claim 2, wherein the monitoring control unit is configured to:

receive the disarm code by receiving, from a monitoring system application running on a user device of a resident of the property, the disarm code.

6. The system of claim 1, wherein:

the package holder device is configured to:

receive an additional package at the package holder device;

secure the additional package;

arm the package holder device;

generate additional location data that indicates an additional location of the package holder device; and the monitoring control unit is configured to:

receive, from the package holder device, additional data indicating that the package holder device secured the additional package and that the package holder device is armed;

communicate, to the user device of the resident of the property, an additional package delivery confirmation notification indicating that the package holder device received and secured the additional package;

receive, from the package holder device, the additional location data that indicates the additional location of the package holder device;

determine that the additional location of the package holder device is outside of a threshold distance from the property;

receive an additional disarm code;

determine that the additional received disarm code to an additional stored disarm code; and based on determining that the package holder device is outside of the threshold distance from the property and determining that the additional received disarm code matches the additional stored disarm code, communicate, to the user device of the resident of the property, a notification indicating the additional location of the package holder device.

7. The system of claim 1, wherein:

the monitor control unit is configured to disarm the package holder device by communicating, to the package holder device, a command to disarm, and the package holder device is configured to:

receive, the command to disarm; and disarm by unlocking one or more arms of the package holder device from around the package.

8. A computer-implemented method comprising:

detecting, by a package holder device of a monitoring system that is configured to monitor a property and that includes the package holder device, that a package has been placed on and secured by the package holder device; and in response to detecting that the package has been placed on and secured by the package holder device:

arming the package holder device; and communicating, to a user device of a resident of the property, a package delivery confirmation notification indicating that the package holder device received and secured the package;

determining that a location of the package holder device is within a building of the property; and based determining that the package holder device is within a building of the property, disarming the package holder device.

9. The method of claim 8, comprising:

receiving a disarm code;

comparing the received disarm code to a stored disarm code;

based on comparing the received disarm code to the stored disarm code, determine that the received disarm code matches the stored disarm code; and disarming the package holder device by disarming the pack based on determining that the location of the package holder device is within the building of the property and based on determining that the received disarm code matches the stored disarm code.

10. The method of claim 9, comprising:

comparing the received disarm code to the stored disarm code by comparing the received disarm code to a disarm code that disarms the monitoring system while the monitoring system is in an armed state, and disarming the package holder device by disarming the package holder device based on the received disarm code matching the disarm code that disarms the monitoring system while the monitoring system is in an armed state.

11. The method of claim 9, comprising:

comparing the received disarm code to the stored disarm code by comparing the disarm code to a disarm code that disarms the package holder device and that does not disarm the monitoring system while the monitoring system is in an armed state, and disarming the package holder device by disarming the package holder device based on the received disarm code matching the disarm code that disarms the package holder device and that does not disarm the monitoring system while the monitoring system is in an armed state.

12. The method of claim 9, comprising:

receiving the disarm code by receiving, from a monitoring system application running on the user device of a resident of the property, the disarm code.

13. The method of claim 8, comprising:

disarming the package holder device by unlocking one or more arms of the package holder device from around the package.

* * * * *